US011926983B2

(12) United States Patent
Isaacson et al.

(10) Patent No.: US 11,926,983 B2
(45) **Date of Patent: *Mar. 12, 2024**

(54) ENCLOSURE COVER ASSEMBLIES

(71) Applicant: Hubbell Incorporated, Shelton, CT (US)

(72) Inventors: Gregory Glenn Isaacson, Fallbrook, CA (US); Robert Brian Denning, Chattanooga, TN (US)

(73) Assignee: Hubbell Incorporated, Shelton, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/966,064

(22) Filed: Oct. 14, 2022

(65) Prior Publication Data

US 2023/0066325 A1 Mar. 2, 2023

Related U.S. Application Data

(63) Continuation of application No. 15/726,462, filed on Oct. 6, 2017, now Pat. No. 11,473,264.

(60) Provisional application No. 62/404,788, filed on Oct. 6, 2016.

(51) Int. Cl.
*E02D 29/14* (2006.01)

(52) U.S. Cl.
CPC ..... *E02D 29/14* (2013.01); *E02D 29/1454* (2013.01)

(58) Field of Classification Search
CPC ..... E02D 29/14; E02D 29/1454
USPC ..... 404/25
See application file for complete search history.

(56) References Cited

U.S. PATENT DOCUMENTS

| | | | | |
|---|---|---|---|---|
| 817,748 | A * | 4/1906 | Boulden et al. | B60J 7/1204 16/349 |
| 1,820,127 | A | 8/1931 | Elkington | |
| 2,801,768 | A | 8/1957 | Immel | |
| 2,881,940 | A | 4/1959 | Hamilton | |
| 2,950,141 | A | 8/1960 | Koff | |
| 3,029,964 | A | 4/1962 | Hudson | |

(Continued)

FOREIGN PATENT DOCUMENTS

| | | |
|---|---|---|
| CA | 3025489 | 11/2017 |
| EP | 0527560 | 2/1993 |

(Continued)

OTHER PUBLICATIONS

Dehaan, Pete; Manhole Frame and Cover Load Bearing Definitions; Nov. 16, 2012; National Precast Concrete Association Screen grab provided, weblink: https://precast.org/2012/11/manhole-frame-and-cover-load-bearing-definitions/ (Year: 2012). (4 pages).

(Continued)

*Primary Examiner* — Gary S Hartmann
(74) *Attorney, Agent, or Firm* — Wissing Miller LLP

(57) ABSTRACT

Underground utility enclosure cover assemblies are used with direct burial enclosures. The cover assemblies include a frame and a cover. The frame has one or more walls that define a central opening, a cover receiving ledge, an overhang that has a sidewall, and at least one stabilizing member extending from a bottom edge of the sidewall of the overhang. The cover is dimensioned to rest on the cover receiving ledge. The frame and the cover are made of a rigid material that permits the frame and cover to support large vertical loads.

19 Claims, 12 Drawing Sheets

(56) References Cited

U.S. PATENT DOCUMENTS

| | | | | |
|---|---|---|---|---|
| 3,217,619 | A | 11/1965 | Driver | |
| 3,405,834 | A | 10/1968 | Butler | |
| 3,468,577 | A | 9/1969 | Mazerka | |
| 3,606,064 | A | 9/1971 | Butler | |
| 3,920,347 | A | 11/1975 | Sauriol | |
| 3,952,908 | A | 4/1976 | Carson | |
| 4,466,219 | A | 8/1984 | Campolito | |
| 4,621,939 | A | 11/1986 | Thomann | |
| 4,861,186 | A | 8/1989 | Ferns | |
| 4,867,600 | A | 9/1989 | Bowman | |
| 4,916,258 | A | 4/1990 | Mohr | |
| 4,919,564 | A | 4/1990 | Neathery | |
| 4,934,715 | A | 6/1990 | Johnson | |
| 5,066,165 | A | 11/1991 | Wofford | |
| 5,194,696 | A | 3/1993 | Read | |
| 5,205,668 | A | 4/1993 | Adams | |
| 5,281,052 | A | 1/1994 | Beamer | |
| 5,462,383 | A | 10/1995 | Van 'T Veer | |
| 5,466,886 | A | 11/1995 | Lengyel | |
| 5,574,254 | A | 11/1996 | Mori | |
| 5,627,340 | A | 5/1997 | Smith | |
| 5,697,729 | A | 12/1997 | Bowman | |
| 5,702,200 | A | 12/1997 | Hawkins | |
| 5,944,210 | A | 8/1999 | Yetter | |
| 6,007,270 | A | 12/1999 | Bowman | |
| 6,035,581 | A | 3/2000 | McCoy | |
| 6,109,824 | A * | 8/2000 | Annes | E03F 5/0401 404/26 |
| 6,220,784 | B1 | 4/2001 | Bricker | |
| 6,371,688 | B1 | 4/2002 | Yang | |
| 6,443,656 | B1 | 9/2002 | Gunter | |
| 6,520,713 | B2 | 2/2003 | Sondrup | |
| 6,595,720 | B2 | 7/2003 | Humphries | |
| 6,688,806 | B2 | 2/2004 | Kuan | |
| 7,144,189 | B1 | 12/2006 | Bongiovanni | |
| 7,413,372 | B2 | 8/2008 | Meyers | |
| 7,501,573 | B2 | 3/2009 | Balfour | |
| 7,588,392 | B2 | 9/2009 | Wroblewski | |
| 7,607,553 | B2 | 10/2009 | Weber | |
| 7,712,515 | B2 | 5/2010 | Sulak | |
| 7,807,923 | B2 | 10/2010 | Moran | |
| 7,967,523 | B2 | 6/2011 | Hetzler | |
| 8,469,628 | B2 | 6/2013 | Miller | |
| 8,511,930 | B2 | 8/2013 | Royer | |
| 8,573,883 | B2 | 11/2013 | Monro | |
| 8,835,757 | B2 | 9/2014 | Freeman | |
| 9,174,798 | B2 | 11/2015 | Freeman | |
| 9,346,593 | B2 | 5/2016 | Nguyen | |
| 9,435,099 | B2 | 9/2016 | Nguyen | |
| 9,667,049 | B1 | 5/2017 | Gretz | |
| 9,876,340 | B2 | 1/2018 | Unger | |
| 10,794,034 | B2 * | 10/2020 | Strand | E02D 29/121 |
| 10,851,515 | B2 | 12/2020 | McKernan | |
| 11,473,264 | B2 * | 10/2022 | Isaacson | E02D 29/1454 |
| 2003/0039510 | A1 * | 2/2003 | Kuan | E02D 29/1427 404/25 |
| 2003/0147693 | A1 | 8/2003 | Knak | |
| 2004/0055231 | A1 | 3/2004 | Dang | |
| 2009/0211779 | A1 | 8/2009 | Drane | |
| 2013/0248534 | A1 | 9/2013 | Dang | |
| 2014/0367328 | A1 | 12/2014 | Allard | |
| 2016/0176629 | A1 | 6/2016 | Dang | |

FOREIGN PATENT DOCUMENTS

| | | |
|---|---|---|
| FR | 2850404 | 7/2004 |
| GB | 168499 | 9/1921 |
| KR | 920005602 | 8/1992 |

OTHER PUBLICATIONS

Christy Concrete Brochure for "Oldcastle Enclosure Solutions"; Nov. 2013. (1 page).

Christy Concrete "Oldcastle Enclosure Solutions Products Catalog"; Feb. 2011. (86 pages).

Oldcastle Precast Inc. "B1730 Cut Sheet" 2009. (1 page).

Canadian Office Action mailed in corresponding Canadian Application No. 2981780 dated Mar. 17, 2021. (4 pages).

Canadian Office Action mailed in corresponding Canadian Application No. 2981780 dated Nov. 23, 2021. (4 pages).

* cited by examiner

ENCLOSURE COVER ASSEMBLIES

CROSS REFERENCE TO RELATED APPLICATIONS

This application is a continuation of co-pending U.S. patent application Ser. No. 15/726,462 filed on Oct. 6, 2017, and claims benefit from U.S. Provisional Application Ser. No. 62/404,788, filed Oct. 6, 2016, the entire contents of both are incorporated herein in their entirety by reference.

BACKGROUND

Field

The present disclosure relates generally to enclosure cover assemblies and, more particularly, to cover assemblies having frames and covers for precast utility enclosures that can support the weight of vehicles enabling the enclosure to be used in high vehicle traffic environments.

Description of the Related Art

Utility companies, such as water, electric, gas, and/or cable television utilities often use subterranean conduits and enclosures to deliver their product to customers. For example, electrical utilities run electrical wires through underground conduits and provide workman access to such wires using buried utility enclosures that have covers at or slightly above grade. The utility enclosures can be buried in the ground, or under roads or sidewalks. The tops of enclosures buried in roadways are subject to significant vehicle weights. To protect buried utility enclosures from damage caused by vehicle traffic, the covers need to be able to withstand such weight.

SUMMARY

The present disclosure provides embodiments of cover assemblies for use with direct burial enclosures. In one exemplary embodiment, an enclosure cover assembly comprises a frame that can be secured to an enclosure and a cover that can be separately secured to the frame. The frame has a central opening providing access to an interior of the enclosure, an overhang and a cover receiving ledge. The cover receiving ledge may be offset from a top of the overhang. The cover receiving ledge includes at least one enclosure mounting tab positioned to align with at least one mounting structure of an enclosure and at least one cover mounting tab. The cover is dimensioned to rest on the cover receiving ledge of the frame, and has at least one opening aligned with the at least one cover mounting tab so that the cover can be secured to the frame.

In one exemplary embodiment, an enclosure cover assembly comprises a frame and a cover. The frame has a pair of side walls, a pair of end walls and a central opening, wherein an end of each side wall meets an end of an end wall. The side walls and end wall include an overhang and a cover receiving ledge. The frame may include at least one stabilizing bracket extending from the overhang such that when the frame is installed on an enclosure the at least one stabilizing bracket can be embedded in concrete surrounding the frame. The cover receiving ledge may be offset from a top of the overhang. The cover receiving ledge includes at least one enclosure mounting tab positioned to align with at least one mounting structure of an enclosure and at least one cover mounting tab. The cover is dimensioned to rest on the cover receiving ledge and has at least one opening aligned with the at least one cover mounting tab such that the cover can be secured to the frame.

BRIEF DESCRIPTION OF THE DRAWINGS

A more complete appreciation of the present disclosure and many of the attendant advantages thereof will be readily obtained as the same becomes better understood by reference to the following detailed description when considered in connection with the accompanying drawings, wherein.

DETAILED DESCRIPTION

The present disclosure provides embodiments of cover assemblies for use with direct burial enclosures. The exemplary embodiments of the cover assemblies according to the present disclosure include a frame that is releasably secured to a top portion of a direct burial enclosure and cover that is releasably secured to the frame.

Figure 1:
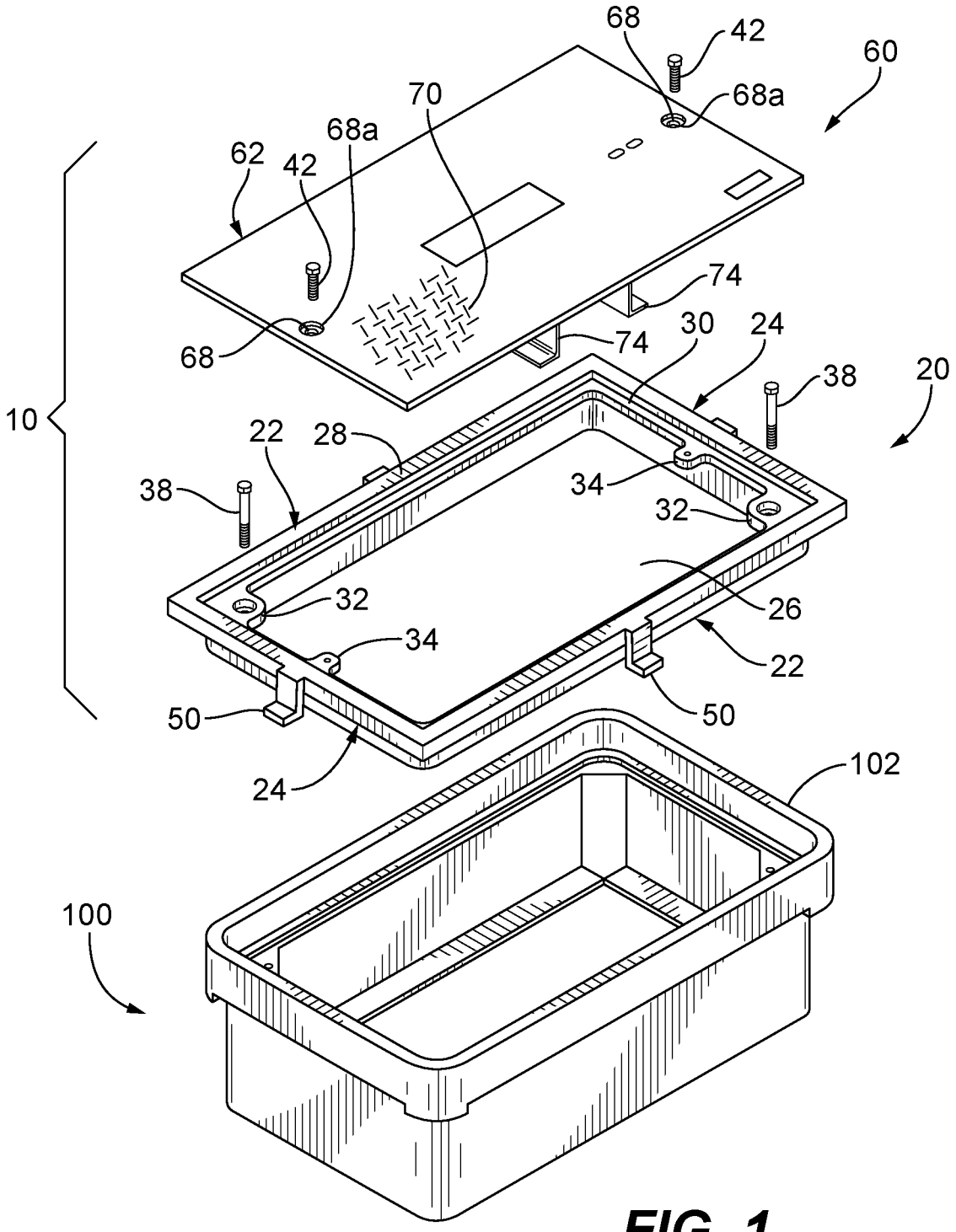
FIG. 1 is top perspective view of an exemplary embodiment of a frame and cover of a cover assembly according to the present disclosure used to cover direct burial enclosures.
Figure 2:
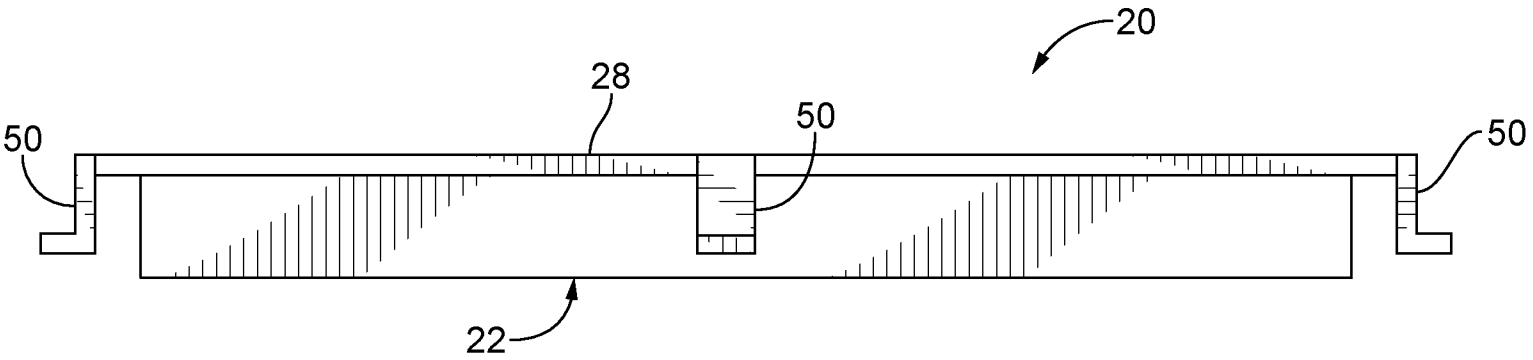
FIG. 2 is a side elevation view of the frame of FIG. 1.

Referring now to the figures, an enclosure cover assembly according to an exemplary embodiment of the present disclosure is shown in FIGS. 1 and 2, and referred to herein as the "assembly." The assembly 10 includes a frame 20 and a cover 60 that are used to cover direct burial enclosures 100 that may be located in an area with high vehicle traffic. The direct burial enclosures 100 are made of high strength concrete, such as polymer concrete, fiberglass reinforced polymer concrete, plastic composites or other high strength material. The frame 20 and cover 60 may be rectangular in shape, square in shape, circular in shape or any other shape, and are dimensioned to fit on a direct burial enclosure 100, such as the enclosure 100 shown in FIG. 1, and to be releasably secured to the enclosure 100. The frame 20 and cover 60 are made of a rigid material sufficient to support vertical loads created by pedestrian and/or vehicle traffic. The frame 20 and cover 60 are preferably made of a rigid material capable of supporting vertical loads that meet the American Association of State Highway Transportation Officials (AASHTO) H-20 and HS-20 loading standards, such as vertical loads of at least about 40,000 lbs. Examples of suitable materials include steel, galvanized steel, cast iron, ductile iron and aluminum.

Referring to FIGS. 2-8, in the exemplary embodiment shown, the frame 20 has two side walls 22 and two end walls 24 forming a rectangular shaped frame. The side walls 22 and end walls 24 may be made as a unitary structure or they may be secured together by, for example, welds. The side walls 22 and end walls 24 when joined form a central opening 26 as shown in FIG. 1, permitting access to an interior of the enclosure 100. The side walls 22 and end walls 24 may be collectively referred to herein as the "walls." An upper portion of the walls has an overhang 28 and a cover receiving ledge 30. The overhang 28 is configured to rest on a top edge 102, as shown in FIG. 1, of the enclosure 100. The cover receiving ledge 30 is preferably offset from the top of the overhang 28 so that when the cover 60 is positioned or nested within the frame 20, a top surface of the cover is even with the top of the overhang. The cover receiving ledge 30 preferably extends along the entire inner periphery of the upper portion of the walls 22 and 24, as shown. However, one skilled in the art would readily appreciate that the cover receiving ledge 30 may comprise a segmented structure, such as the segmented structure shown in FIG. 4.

Figure 3:
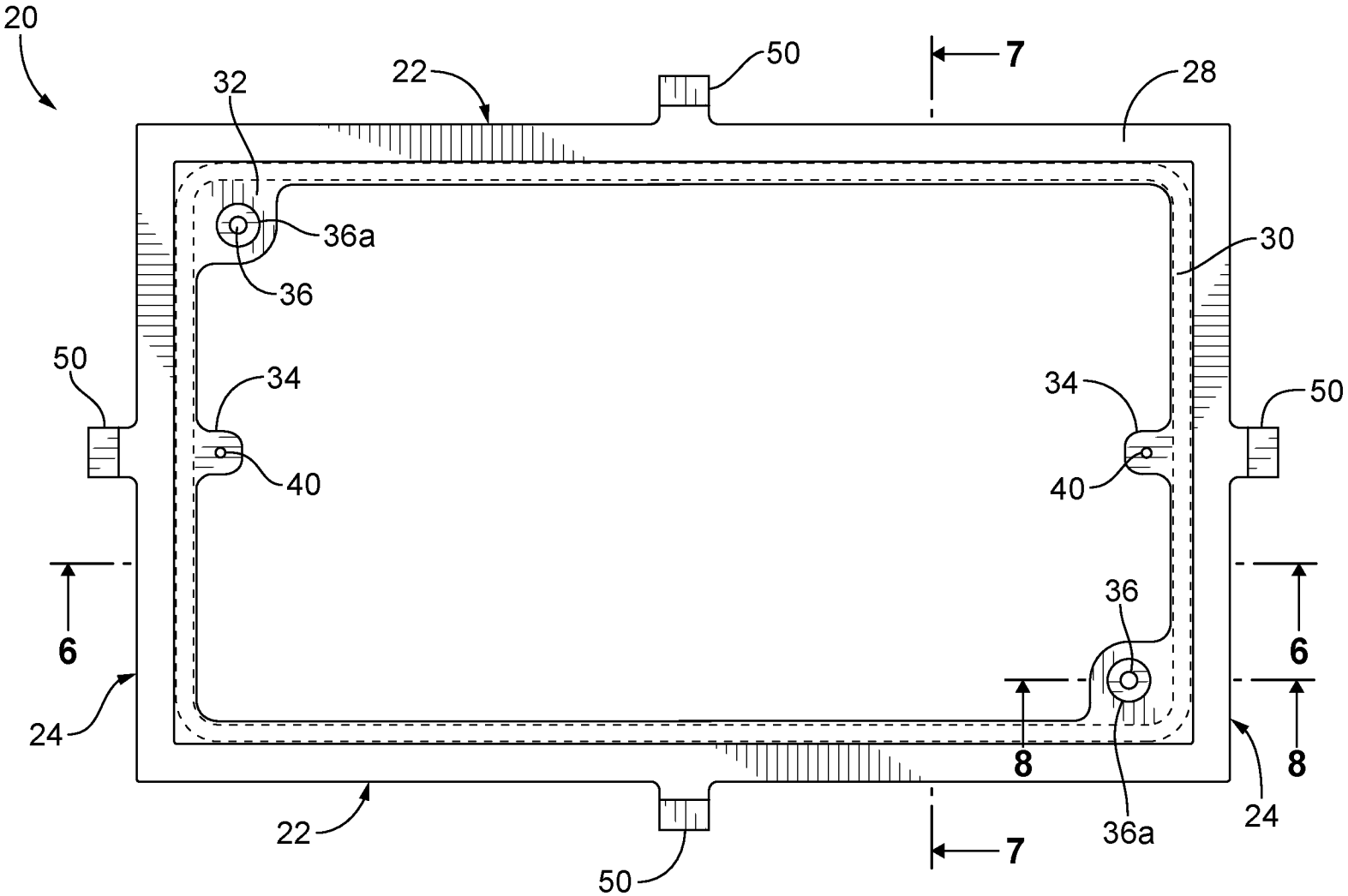
FIG. 3 is top plan view of the frame of FIG. 1.
Figure 4:
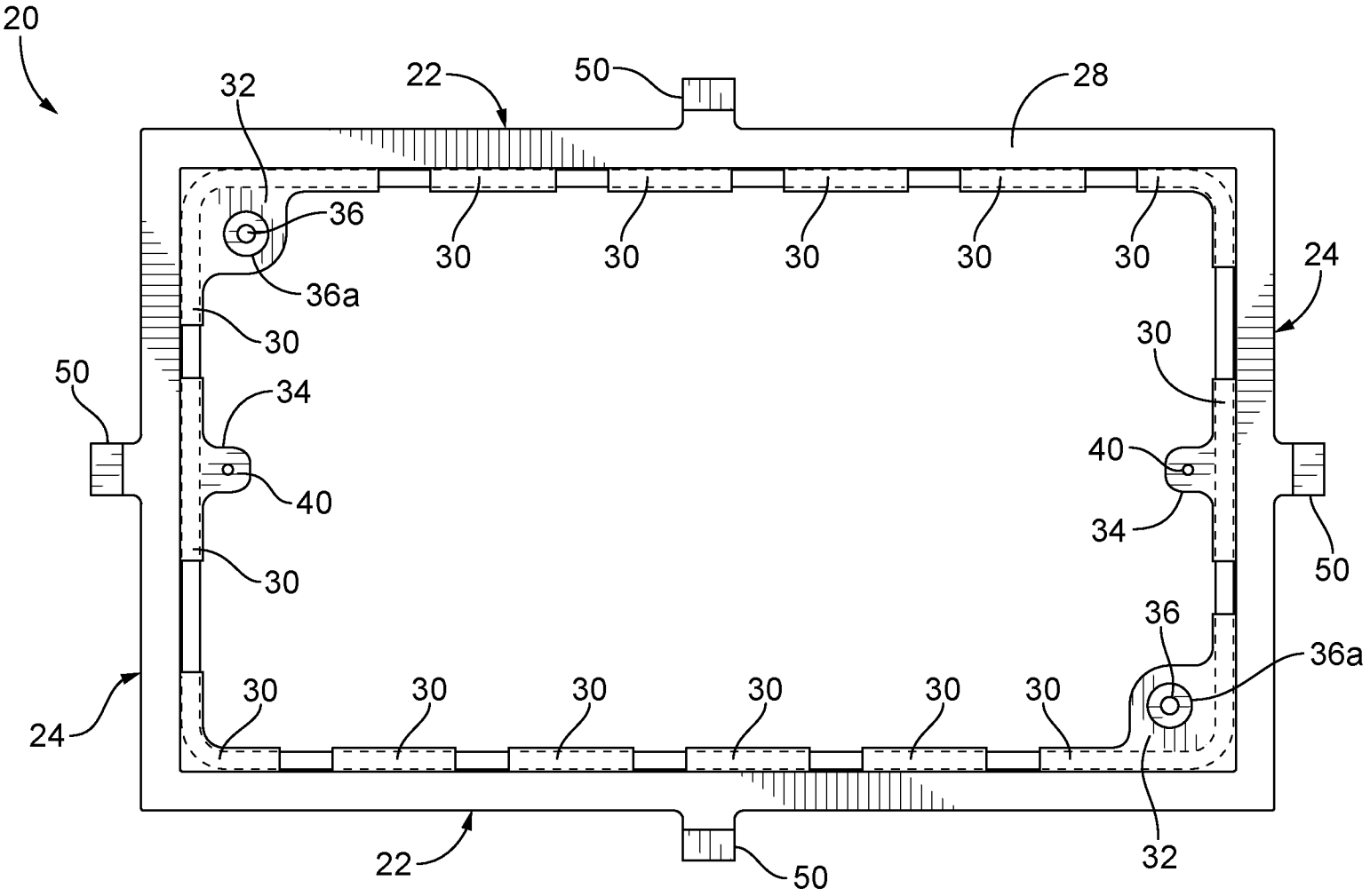
FIG. 4 is top plan view of another exemplary embodiment of the frame according to the present disclosure illustrating a segmented cover receiving ledge.
Figure 5:
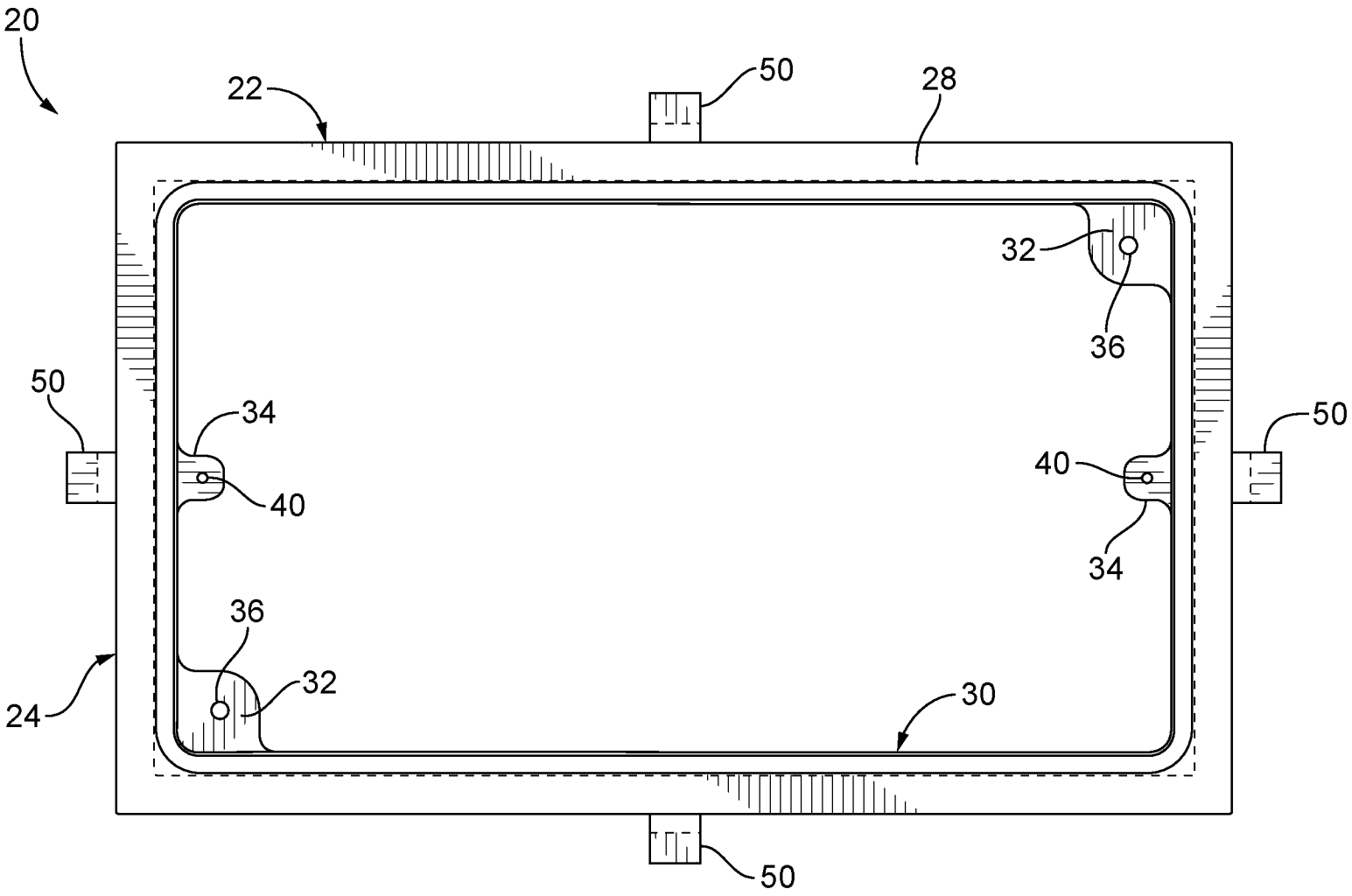
FIG. 5 is a bottom plan view of the frame of FIG. 3.

The cover receiving ledge 30 includes one or more enclosure mounting tabs 32 and one or more cover mounting tabs 34, as shown in FIGS. 3 and 5. The enclosure mounting tabs 32 and cover mounting tabs 34 can be integrally formed into the cover receiving ledge 30 and thus the side walls 22 and end walls 24, are secured to the cover receiving ledge 30 using known techniques, such as welding.

The enclosure mounting tabs 32 can be positioned anywhere along the side walls 22, the end walls 24 or both the side walls and the end walls. Preferably, the enclosure mounting tabs 32 are positioned at the corners of the walls 22 and 24 so that the frame 20 can be secured to existing mounting structures. Non-limiting examples of such mounting structures include threaded apertures or clips, in for example the corners of the underground enclosure 100. In the embodiment shown, there are two enclosure mounting tabs 32 positioned at opposite corners of the walls 22 and 24. Each enclosure mounting tab 32 includes an aperture 36 through which a mounting fastener 38, e.g., the bolt 38 as seen in FIG. 1, can pass. As a non-limiting example, the threaded aperture 36 and mounting fastener 38 may be similar to a wedge ramp style bolt and nut configuration that resists backing out of the bolt caused by vibrations on a road surface or pedestrian walkway due to vehicle or pedestrian traffic. The aperture 36 may include a recess portion 36*a*, shown in FIG. 8, so that the head of the mounting bolt 38 and a washer (not shown) may come to rest. By recessing the bolt 38 head, the cover 60 is flush with the cover receiving ledge 30 when installed.

The one or more cover mounting tabs 34 can be positioned anywhere along the side walls 22, the end walls 24 or both the side walls and the end walls so that the cover 60 can be secured to the frame. In the embodiment shown, there are two cover mounting tabs 34, each positioned at or near a midpoint along the end walls 24 of the frame 20. As a non-limiting example, each cover mounting tab 34 may include a threaded aperture 40 through which a mounting fastener 42, seen in FIG. 1, can be used to secure the cover 60 to the frame 20.

Figure 6:
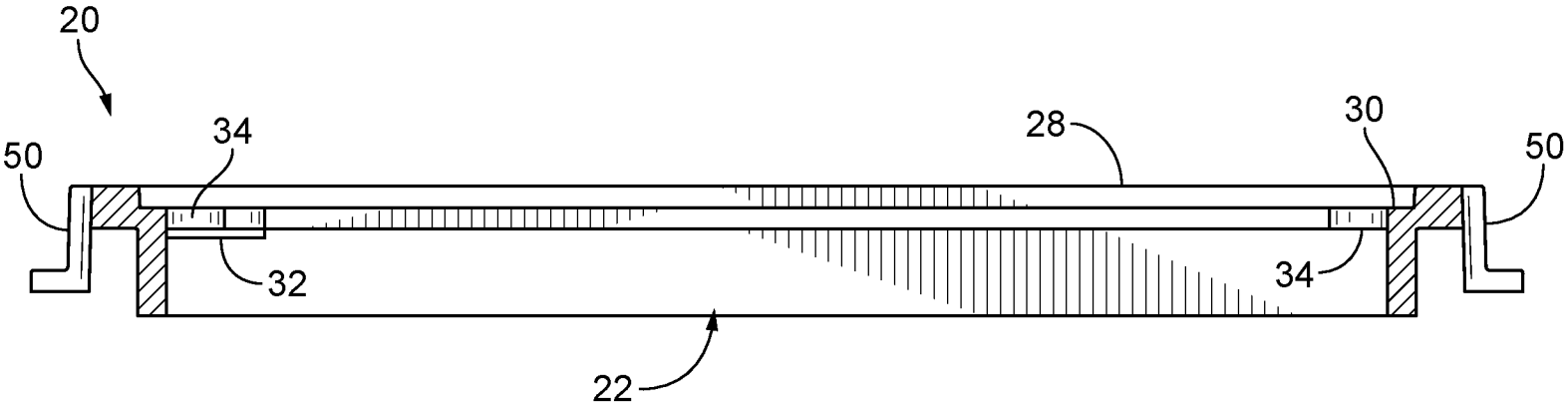
FIG. 6 is a cross-sectional view of the frame of FIG. 3 taken along line 6-6.
Figure 7:
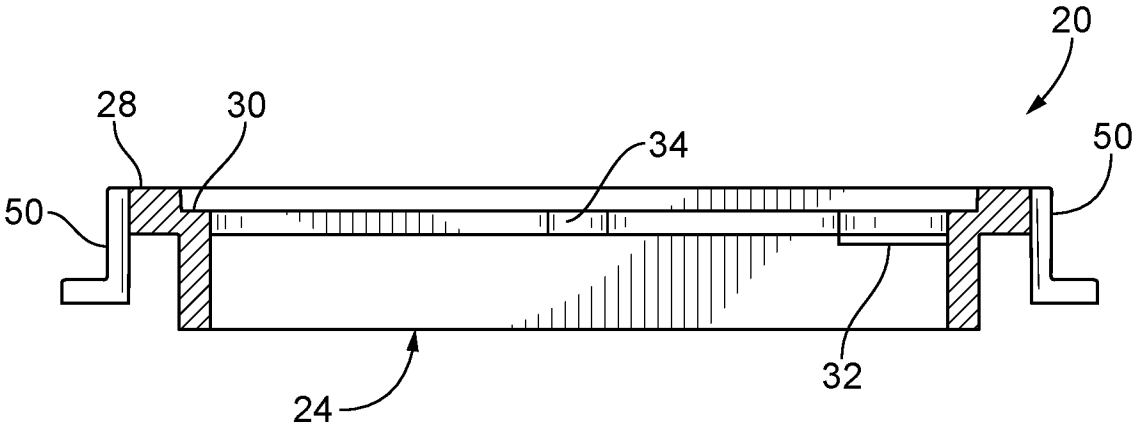
FIG. 7 is a cross-sectional view of the frame of FIG. 3 taken along line 7-7.
Figure 8:
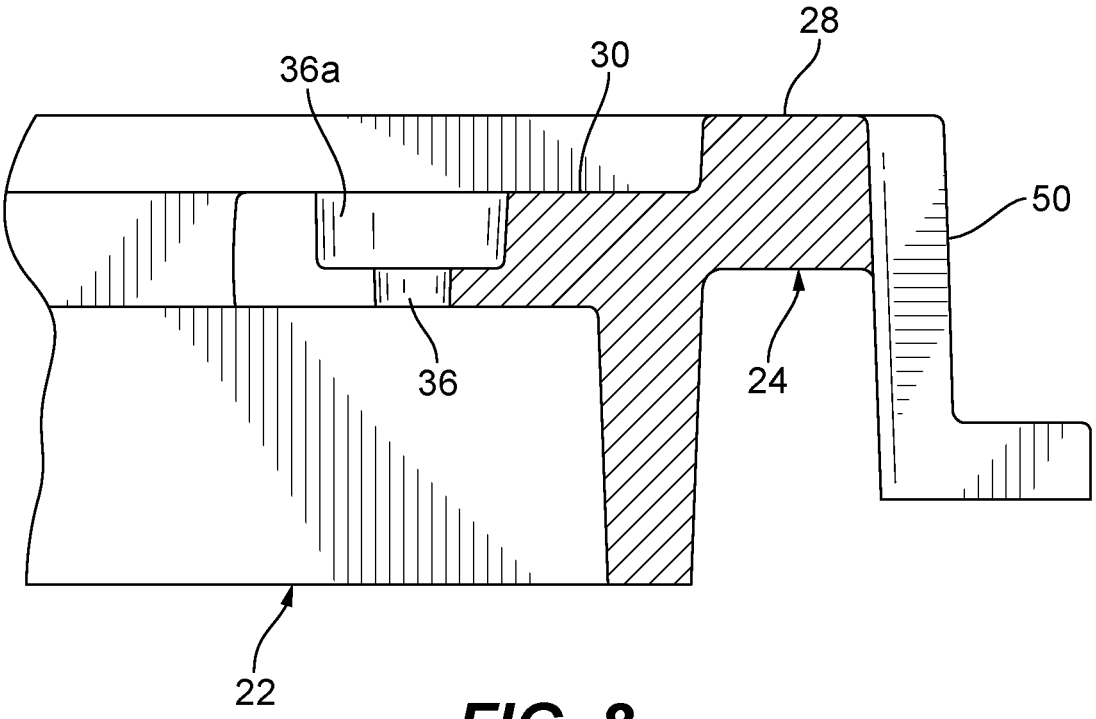
FIG. 8 is a partial cross-sectional view of the frame of FIG. 3 taken along line 8-8.
Figure 9:
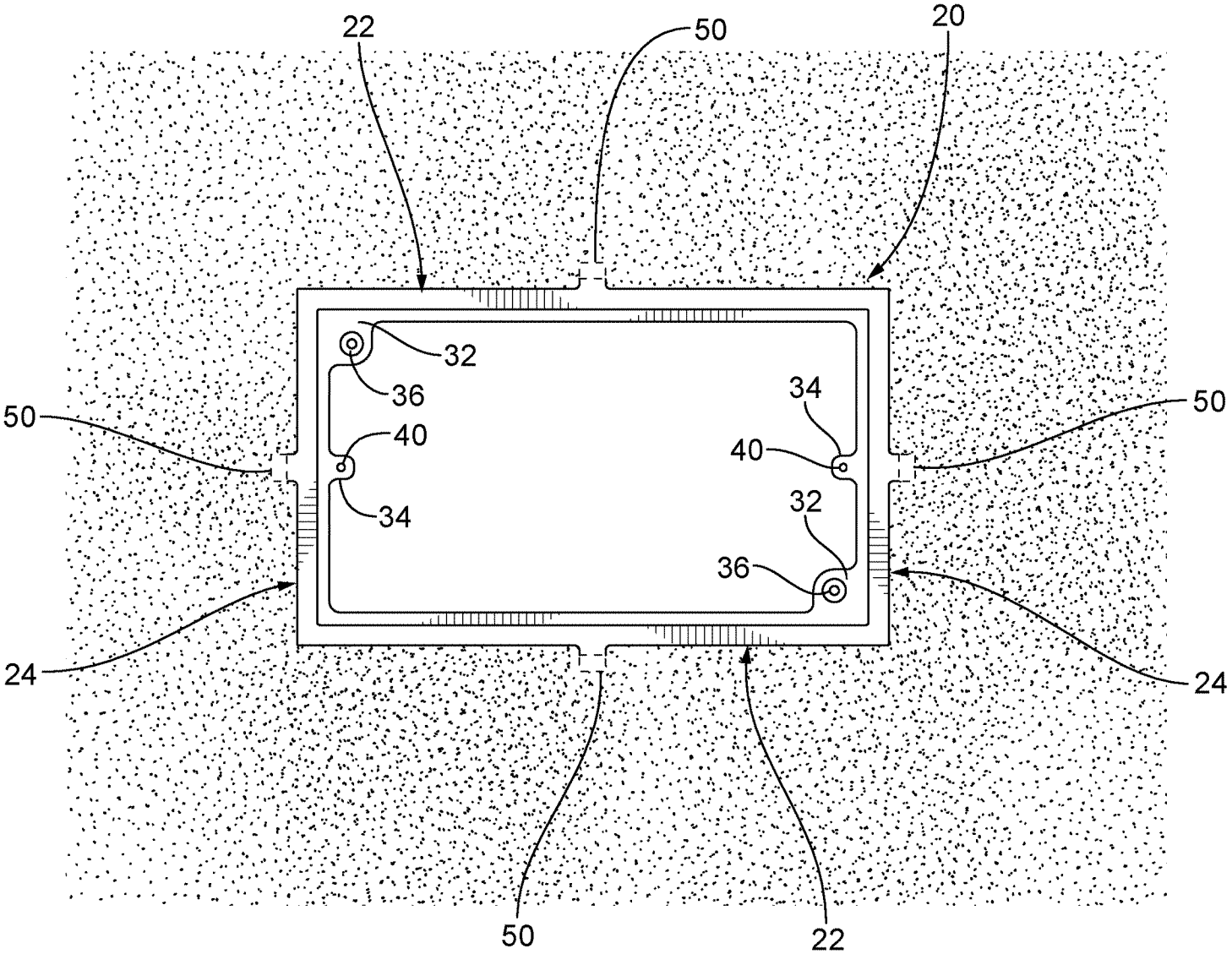
FIG. 9 is a top plan view of the cover assembly according to the present disclosure secured to an underground enclosure surrounded by concrete.

Extending from an outer surface of the overhang 28 on the side walls 22, the end walls 24 or both the side walls and the end walls are one or more stabilizing brackets 50. As a non-limiting example, in the embodiment shown, each side wall 22 has one stabilizing bracket 50 and each end wall 24 has one stabilizing bracket. However, each side wall can have more than stabilizing bracket, and each end wall can have more than one stabilizing bracket. Each stabilizing bracket 50 extends downward and away from the walls 22 and/or 24 so that a portion of the stabilizing brackets can occupy an area around a perimeter of the frame. The stabilizing brackets 50 can then be embedded in concrete poured around the enclosure 100, as shown in FIG. 9. The stabilizing brackets 50 when embedded in concrete distribute vertical loads on the assembly 10 to the surrounding concrete thus stabilizing the frame 20 and cover 60 relative to the surrounding concrete. In the embodiment shown, the stabilizing brackets 50 are L-shaped brackets, as seen in FIGS. 6 and 7. However the stabilizing brackets 50 may come in many different shapes and sizes.

Figure 10:
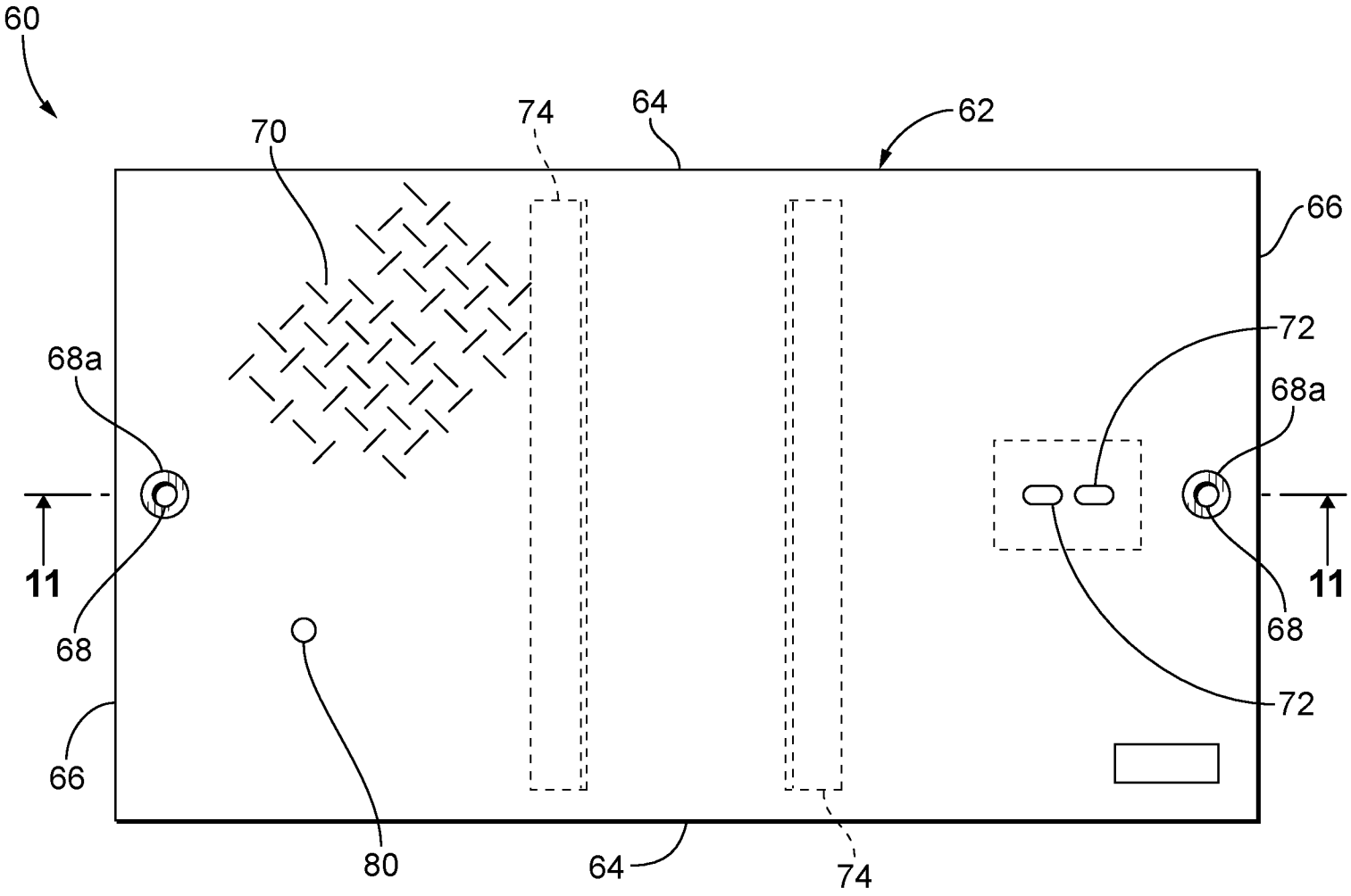
FIG. 10 is a top plan view of the cover of FIG. 1.
Figure 11:
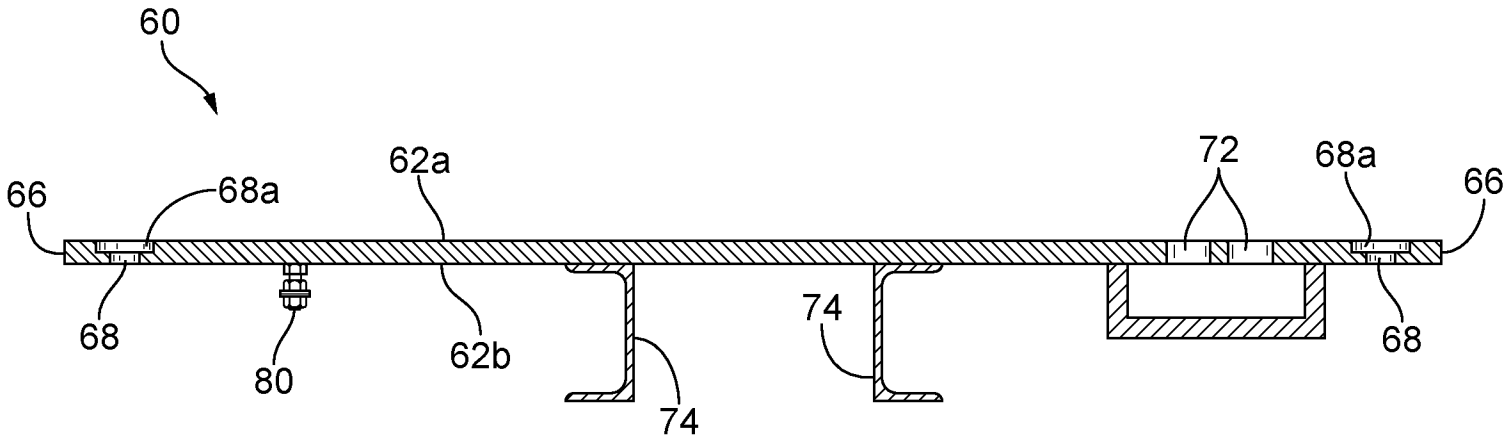
FIG. 11 is a cross sectional view of the cover of FIG. 10 taken along line 11-11.

Referring now to FIGS. 10 and 11, an exemplary embodiment of a cover 60 is shown. In this exemplary embodiment, the cover 60 comprises a body 62 having a top surface 62*a* and a bottom surface 62*b*, two side edges 64 and two end edges 66 forming a rectangular shaped cover. As noted, the cover 60 is configured and dimensioned to rest on the cover receiving ledge 30 of the frame 20. As also noted, the body 62 is made of a rigid material capable of supporting loads of at least about 40,000 lbs. The body 62 also includes one or more apertures 68 through which mounting fasteners 42, e.g., the bolts seen in FIG. 1, can pass. As a non-limiting example, the threaded aperture 68 and mounting fasteners 42 may be similar to a wedge ramp style bolt and nut configuration that resists backing out of the bolt caused by vibrations on a road surface or pedestrian walkway due to vehicle or pedestrian traffic. Preferably, the number of apertures 68 corresponds to the number of cover mounting tabs 34 so that the mounting fasteners 42 can be passed through the body 62 and threaded into the threaded apertures 40 in corresponding cover mounting tabs 34. The apertures 68 may include a recess portion 68*a*, shown in FIG. 11, so that the mounting fastener 42, e.g., the head of the mounting bolt and a washer (not shown), may come to rest. Recessing the mounting fastener 42 prevents the mounting fastener from extending above the top surface 62*a* of the body 62 when installed. The top surface 62*a* of the body 62 may include one or more slip resistant members 70. The one or more slip resistant members 70 may comprise, for example, treads shown in FIG. 10, slip resistant paints, slip resistant tapes, or other slip resistant materials or structures. The top surface 62*a* of the body 62 may include one or more openings 72 where a hook or other tool may be used to lift the cover 60 away from the frame 20 to permit access to an interior of the enclosure 100. The cover 60 may also include one or more ribs 74 that are provided to enhance the vertical load capacity of the cover 60. The ribs may be positioned to extend from one side edge 64 to the other side edge 64 as shown in FIG. 10, one end edge 66 to the other end edge 66, or the ribs 74 may be arranged in different patterns as is known. A ground lug 80 may be secured to the body 62 so that the ground lug extends from the bottom surface 62*b* of the body. The ground lug 80 can be connected to a ground wire or rod and used to electrically ground the cover 60 and thus the frame 20 via the mounting fasteners 42 between the cover 60 and the frame 20.

Figure 12:
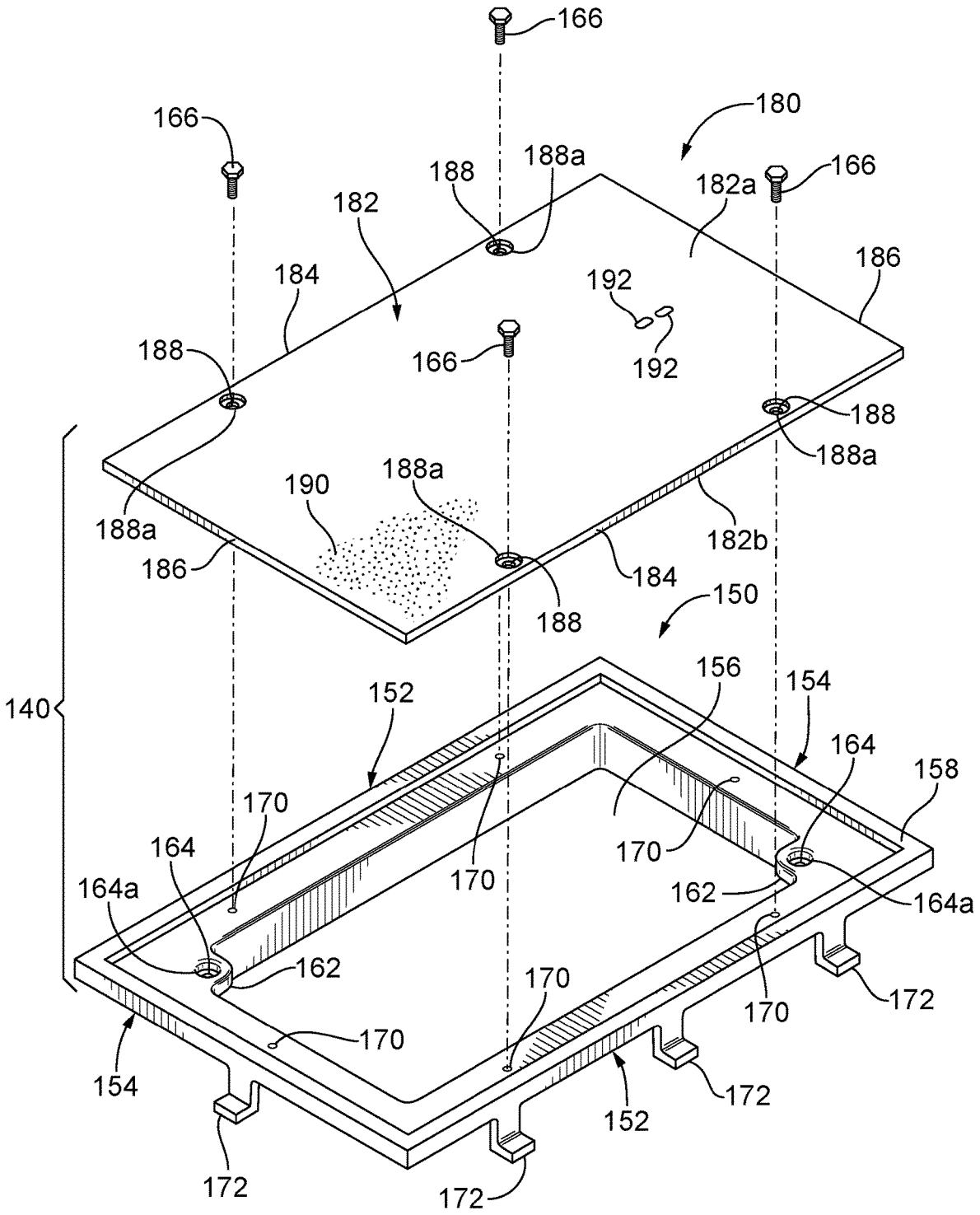
FIG. 12 is a top perspective view of another exemplary embodiment of a frame and cover of a cover assembly according to the present disclosure used to cover direct burial enclosures.
Figure 13:
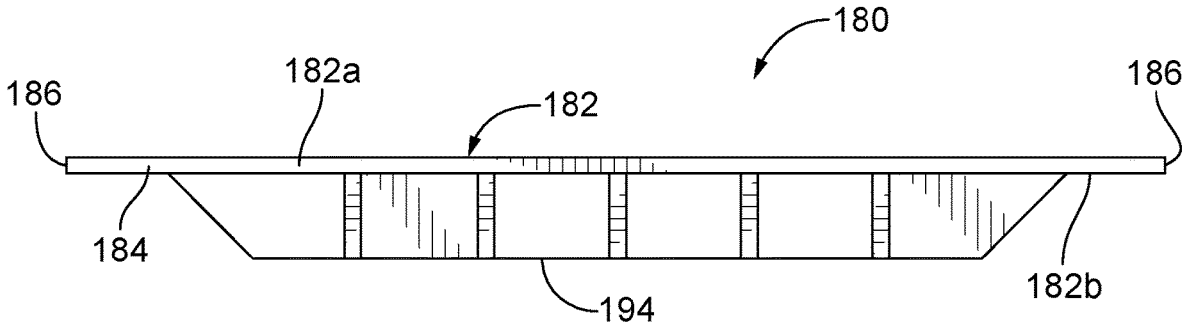
FIG. 13 is a side elevation view of the cover of FIG. 12.
Figure 14:
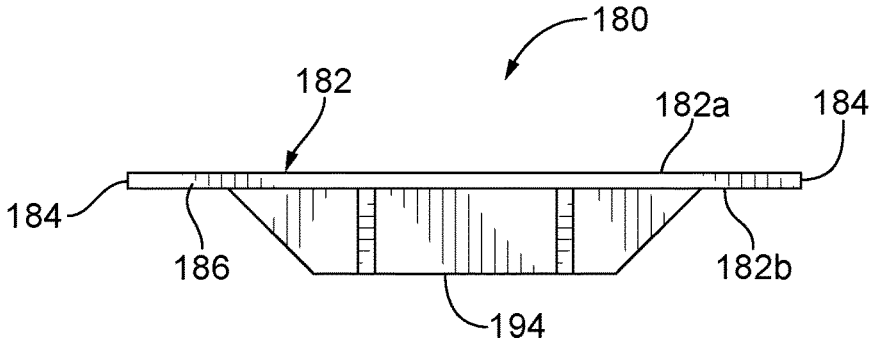
FIG. 14 is an end elevation view of the cover of FIG. 12.

Referring now to the FIGS. 12-14, another exemplary embodiment of an enclosure cover assembly according to the present disclosure is shown. The assembly 140 includes a frame 150 and a cover 180 that are used to cover direct burial enclosures 100, such as the enclosure 100 shown in FIG. 1 and described above, that may be located in an area with high vehicle traffic. The frame 150 and cover 180 may be rectangular in shape, square in shape, circular in shape or any other shape, and are dimensioned to fit on a direct burial enclosure, such as the enclosure 100 shown in FIG. 1, and to be releasably secured to the enclosure. The frame 150 and cover 180 are made of a rigid material sufficient to support vertical loads created by pedestrian and/or vehicle traffic. The frame 150 and cover 180 are preferably made of a rigid material capable of supporting vertical loads that meet the American Association of State Highway Transportation Officials (AASHTO) H-20 and HS-20 loading standards, such as vertical loads of at least about 40,000 lbs. Examples of suitable materials include steel, galvanized steel, cast iron, ductile iron and aluminum.

Continuing to refer to FIG. 12, in the exemplary embodiment shown, the frame 150 has two side walls 152 and two end walls 154 forming a rectangular shaped frame. The side walls 152 and end walls 154 may be made as a unitary structure or they may be secured together by, for example, welds. The side walls 152 and end walls 154 when joined form a central opening 156 permitting access to an interior of an enclosure. The side walls 152 and end walls 154 may be collectively referred to herein as the "walls." An upper portion of the walls has an overhang 158 and a cover receiving ledge 160. The overhang 158 is configured to rest on a top edge 102 of the enclosure 100, seen in FIG. 1. The cover receiving ledge 160 is preferably offset from the top of the overhang 158 so that when the cover 180 is positioned or nested within the frame 150, a top surface of the cover 180 is even with the top of the overhang. The cover receiving ledge 160 preferably extends along the entire inner periphery of the upper portion of the walls 152 and 154, as shown. However, one skilled in the art would readily appreciate that the cover receiving ledge 160 may comprise a segmented structure, such as the segmented structure shown in FIG. 4.

In the exemplary embodiment shown in FIG. 12, the cover receiving ledge 160 includes one or more enclosure mounting tabs 162 used for securing the frame 150 to an enclosure. The enclosure mounting tabs 162 can be integrally formed into the cover receiving ledge 160 and thus the side walls 152 and end walls 154, or the enclosure mounting tabs can be secured to the cover receiving ledge 160 using known techniques, such as welding. The enclosure mounting tabs 162 can be positioned anywhere along the side walls 152, the end walls 154 or both the side walls and the end walls. Preferably, the enclosure mounting tabs 162 are positioned at the corners of the walls 152 and 154 so that the frame 150 can be secured to existing mounting structures. Non-limiting examples of such mounting structures include threaded apertures or clips, in for example the corners of the enclosure 100. In the embodiment shown, there are two enclosure mounting tabs 162 positioned at opposite corners of the walls 152 and 154. Each enclosure mounting tab 162 includes an aperture 164 through which a mounting fastener 166, e.g., a bolt, can pass. As a non-limiting example, the threaded aperture 164 and mounting fastener 166 may be similar to a wedge ramp style bolt and nut configuration that resists backing out of the bolt caused by vibrations on a road surface or pedestrian walkway due to vehicle or pedestrian traffic. The aperture 164 may include a recess portion 164*a* so that the head of the mounting fastener 166, e.g, the head of the bolt and a washer (not shown) may come to rest. By recessing the mounting fastener 166, the cover 180 can rest flush with the cover receiving ledge 160 when installed.

The cover receiving ledge 160 also includes one or more cover mounting inserts 170 used to secure the cover 180 to the frame 150. The one or more cover mounting inserts 170 can be positioned anywhere along the cover receiving ledge 160 of the side walls 152, the end walls 154 or both the side walls and the end walls so that the cover 180 can be secured to the frame 150. In the embodiment shown, there are a plurality of cover mounting inserts 170 positioned along the cover receiving ledge 160 of the side walls 152 and the end walls 154. As a non-limiting example, each cover mounting insert 170 may include a threaded aperture through which a mounting fastener 166 can be used to secure the cover 180 to the frame 150.

Extending from an outer surface of the overhang 158 on the side walls 152, the end walls 154 or both the side walls and the end walls are one or more stabilizing brackets 172. As a non-limiting example, in the embodiment shown, each side wall 152 has three stabilizing brackets 172 and each end wall 154 has one stabilizing bracket 172. However, each side wall can have less than or more than three stabilizing brackets, and each end wall can have more than one stabilizing bracket. Each stabilizing bracket 172 extends downward and away from the walls 152 and/or 154 so that a portion of the stabilizing brackets can occupy an area around a perimeter of the frame 150. The stabilizing brackets 172 can then be embedded in concrete poured around the enclosure 100, as shown in FIG. 9. The stabilizing brackets 172 when embedded in concrete distribute vertical loads on the assembly 140 to the surrounding concrete thus stabilizing the frame 150 and cover 180 relative to the surrounding concrete. In the embodiment shown, the stabilizing brackets 172 are L-shaped brackets. However, the stabilizing brackets 172 may come in many different shapes and sizes.

Continuing to refer to FIG. 12, an exemplary embodiment of a cover 180 is shown. In this exemplary embodiment, the cover 180 includes a body 182 having a top surface 182*a* and a bottom surface 182*b*, two side edges 184 and two end edges 186 forming a rectangular shaped cover. As noted, the cover 180 is configured and dimensioned to rest on the cover receiving ledge 160 of the frame 150. As also noted, the body 182 is made of a rigid material capable of supporting loads of at least about 40,000 lbs. The body 182 also includes one or more apertures 188 through which mounting fasteners 166 can pass. The number of apertures 188 may correspond to the number of cover mounting inserts 170 so that the mounting fasteners 166 can be passed through the body 182 and threaded into the threaded inserts 170 in the cover receiving ledge 160. In the exemplary embodiment shown, there are four apertures 188 corresponding to the four cover mounting inserts 170 along the side walls 152 of the frame 150. The apertures 188 may include a recess portion 188*a* so that the head of the mounting fastener 166 and a washer (not shown) may come to rest. Recessing the mounting fastener 166 prevents the mounting fastener from extending above the top surface 182*a* of the body 182 when installed. The top surface 182*a* of the body 182 may include one or more slip resistant members 190. The one or more slip resistant members 190 may comprise, for example, treads, slip resistant paints, slip resistant tapes, or other slip resistant materials or structures. The top surface 182*a* of the body 182 may include one or more openings 192 where a hook or other tool may be used to lift the cover 180 away from the frame 150 to permit access to an interior of the enclosure 100. The cover 180 may also include one or more ribs 194, seen in FIGS. 13 and 14, that are provided to enhance the vertical load capacity of the cover 180. In an exemplary embodiment, ribs 194 may be positioned so they extend from a point spaced from one side edge 184 to a point spaced from the other side edge 184, as seen in FIG. 14, and ribs 194 may be positioned so they extend from a point spaced from one end edge 186 to a point spaced from the other end edge 186, as seen in FIG. 13. In another exemplary embodiment, the ribs may be positioned to extend from one side edge 184 to the other side edge 184, one end edge 186 to the other end edge 186, or the ribs 194 may be arranged in different patterns as is known. A ground lug, similar to ground lug 80 shown in FIG. 11, may be secured to the body 182 so that the ground lug extends from the bottom surface 182*b* of the body. The ground lug can be connected to a ground wire or rod and used to electrically ground the cover 180 and thus the frame 150 via the mounting fasteners 166 between the cover 180 and the frame 150.

While illustrative embodiments have been described and illustrated above, it should be understood that these are exemplary and are not to be considered as limiting. Additions, deletions, substitutions, and other modifications can be made without departing from the spirit or scope of the present disclosure. Accordingly, the invention is not to be considered as limited by the foregoing description.

What is claimed is:

1. An underground utility enclosure cover assembly comprising:

a frame including:

at least one wall forming a central opening;

a cover receiving ledge secured to the at least one wall and extending beyond an outer perimeter of the at least one wall;

an overhang secured to an outer edge of the cover receiving ledge, the overhang having a sidewall; and at least one stabilizing member extending from a bottom edge of the sidewall of the overhang in a direction away from the central opening; and a cover dimensioned to rest on the cover receiving ledge;

wherein the frame and the cover are made of a rigid material that permits the frame and cover to support vertical loads of at least about 40,000 lbs.

2. The enclosure cover assembly according to claim 1, wherein the at least one stabilizing member comprises a plurality of stabilizing members.

3. The enclosure cover assembly according to claim 1, wherein the at least one wall comprises a pair of side walls and a pair of end walls, and wherein an end of each side wall meets an end of an end wall forming a rectangular shaped frame.

4. The enclosure cover assembly according to claim 1, wherein the at least one wall comprises a pair of side walls and a pair of end walls wherein an end of each side wall meets an end of an end wall forming a square shaped frame.

5. The enclosure cover assembly according to claim 1, wherein the rigid material comprises at least one of steel, galvanized steel, cast iron, ductile iron and aluminum.

6. The enclosure cover assembly according to claim 1, wherein the frame is a unitary structured frame.

7. The enclosure cover assembly according to claim 1, wherein the cover receiving ledge includes at least one cover mounting tab and the cover includes at least one opening aligned with the at least one cover mounting tab such that the cover can be secured to the frame.

8. An underground utility enclosure cover assembly comprising:

a frame including:

a pair of side walls and a pair of end walls, wherein an end of each side wall meets an end of an end wall such that a central opening is formed within the pair of side walls and the pair of ends walls;

a cover receiving ledge secured to an edge of each side wall and each end wall so that the cover receiving ledge extends beyond a perimeter of the pair of side walls and the pair of end walls;

an overhang secured to an outer edge of the cover receiving ledge, the overhang having a sidewall; and at least one stabilizing member extending from a bottom edge of the sidewall of the overhang in a direction away from the central opening;

a cover dimensioned to rest on the cover receiving ledge;

wherein the frame and the cover are made of a rigid material that permits the frame and cover to support vertical loads of at least about 40,000 lbs.

9. The enclosure cover assembly according to claim 8, wherein the at least one stabilizing member comprises a plurality of stabilizing members.

10. The enclosure cover assembly according to claim 8, wherein the rigid material comprises at least one of steel, galvanized steel, cast iron, ductile iron and aluminum.

11. The enclosure cover assembly according to claim 8, wherein the frame is a unitary structured frame.

12. The enclosure cover assembly according to claim 8, wherein the cover receiving ledge includes at least one cover mounting tab, and the cover includes at least one opening aligned with the at least one cover mounting tab such that the cover can be secured to the frame.

13. An underground utility enclosure assembly comprising:

an enclosure; and an enclosure cover assembly including:

a frame having at least one wall forming a central opening, a cover receiving ledge secured to the at least one wall and extending beyond an outer perimeter of the at least one wall, an overhang secured to an outer edge of the cover receiving ledge, the overhang having a sidewall, and at least one stabilizing member extending from a bottom edge of the sidewall of the overhang in a direction away from the central opening; and a cover dimensioned to rest on the cover receiving ledge;

wherein the frame and the cover are made of a rigid material that permits the frame and cover to support vertical loads of at least about 40,000 lbs.

14. The utility enclosure assembly according to claim 13, wherein the at least one stabilizing member comprises a plurality of stabilizing members.

15. The utility enclosure assembly according to claim 13, wherein the at least one wall comprises a pair of side walls and a pair of end walls, and wherein an end of each side wall meets an end of an end wall forming a rectangular shaped frame.

16. The utility enclosure assembly according to claim 13, wherein the at least one wall comprises a pair of side walls and a pair of end walls wherein an end of each side wall meets an end of an end wall forming a square shaped frame.

17. The utility enclosure assembly according to claim 13, wherein the rigid material comprises at least one of steel, galvanized steel, cast iron, ductile iron and aluminum.

18. The utility enclosure assembly according to claim 13, wherein the frame is a unitary structured frame.

19. The utility enclosure assembly according to claim 13, wherein the cover receiving ledge includes at least one cover mounting tab and the cover includes at least one opening aligned with the at least one cover mounting tab such that the cover can be secured to the frame.

* * * * *